US012298100B2

(12) United States Patent
Roberson

(10) Patent No.: US 12,298,100 B2
(45) Date of Patent: May 13, 2025

(54) FIREARM ACCESSORY CONFIGURED FOR ATTACHMENT TO A RAIL SYSTEM

(71) Applicant: Arisaka LLC, Apex, NC (US)

(72) Inventor: William Roberson, Apex, NC (US)

(73) Assignee: Arisaka LLC, Apex, NC (US)

( * ) Notice: Subject to any disclaimer, the term of this patent is extended or adjusted under 35 U.S.C. 154(b) by 0 days.

(21) Appl. No.: 18/427,430

(22) Filed: Jan. 30, 2024

(65) Prior Publication Data

US 2024/0410673 A1 Dec. 12, 2024

Related U.S. Application Data

(60) Provisional application No. 63/443,218, filed on Feb. 3, 2023.

(51) Int. Cl.
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS 7,121,034 B2 * 10/2006 Keng ..... F41A 23/10 42/72
7,191,557 B2 * 3/2007 Gablowski ..... F41C 23/16 42/72
8,245,428 B2 8/2012 Griffin
8,839,544 B2 * 9/2014 Troy ..... F41C 23/16 42/72
9,857,146 B1 1/2018 Shelton et al.
10,107,586 B2 * 10/2018 Derousse ..... F41C 23/12
2005/0188588 A1 * 9/2005 Keng ..... F41A 23/10 42/72
2006/0064913 A1 * 3/2006 Gablowski ..... F41C 23/16 42/72
2014/0115939 A1 * 5/2014 Troy ..... F41C 23/16 42/72
2016/0245616 A1 * 8/2016 Derousse ..... F41C 23/16
2017/0176136 A1 * 6/2017 Derousse ..... F41C 23/12
2017/0227320 A1 * 8/2017 Derousse ..... F41C 23/16
2018/0120053 A1 * 5/2018 Kolb ..... F41C 23/02
2021/0108885 A1 * 4/2021 Derousse ..... F41C 23/16

* cited by examiner

*Primary Examiner* — Jonathan C Weber

(74) *Attorney, Agent, or Firm* — Asgaard Patent Services, LLC; F. Wayne Thompson, Jr.

(57) ABSTRACT

Disclosed is a firearm accessory with a clamping mechanism used to removably attach the firearm accessory to a rail system, such as a Picatinny rail. The clamping mechanism includes a pair of parallel engagement members and a reversibly extendable recoil lug, which is disposed within a guide groove in the firearm accessory. Additionally, the clamping mechanism includes a threaded fastener that is operatively connected to the recoil lug and is used to advance the recoil lug from, and retract the recoil lug into, the guide groove.

6 Claims, 5 Drawing Sheets

FIREARM ACCESSORY CONFIGURED FOR ATTACHMENT TO A RAIL SYSTEM

CROSS-REFERENCE TO RELATED APPLICATION(S)

This application claims the benefit of U.S. Provisional Application Ser. No. 63/443,218, filed on Feb. 3, 2023, the entirety of which is incorporated herein by reference.

TECHNICAL FIELD

This disclosure relates to a firearm accessory configured for attachment to a rail system of a firearm. Methods of installing and using the firearm accessory are also disclosed.

BACKGROUND

Rail systems are used for mounting various accessories, such as foregrips, hand stops, and bipods, to firearms such as rifles and pistols. The MIL-STD 1913 Picatinny rail, or Picatinny rail, is one such rail system and is characterized by its unique design and dimensions. Unlike other rail systems that may use specific slot configurations, the Picatinny rail is known for its distinct, uniform cross-sections and spacing between slots. This standardization makes it widely compatible with a range of accessories. However, due to its specific design, accessories configured for other types of rail systems may not be directly compatible with the Picatinny rail. Therefore, there is a demand for firearm accessories able to securely clamp onto Picatinny rails.

Accordingly, needs exist for the firearm accessory disclosed herein. It is to the provision of a firearm accessory configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a firearm accessory with a clamping mechanism used to removably attach the firearm accessory to a rail system, such as a Picatinny rail. The clamping mechanism includes a pair of parallel engagement members and a reversibly extendable recoil lug, which is disposed within a guide groove in the firearm accessory. Additionally, the clamping mechanism includes a threaded fastener that is operatively connected to the recoil lug and is used to advance the recoil lug from, and retract the recoil lug into, the guide groove.

An example firearm accessory comprises: a body having a mounting interface configured for removable attachment to a rail system, the mounting interface including a pair of parallel engagement members configured to be slidably coupled to the rail system and an internal groove that defines shoulder surfaces; a reversibly extendable recoil lug disposed within a guide groove located in the mounting interface, between the parallel engagement members; and a threaded fastener comprising a head and a threaded shank. The reversibly extendable recoil lug is configured to slidably fit within the guide groove and to be received within a cross slot of the rail system. The reversibly extendable recoil lug is advanced from and retracted into the guide groove by the threaded fastener. The head of the threaded fastener is rotatably captured by the internal groove of the body and the threaded shank extends between the shoulder surfaces to threadedly engage with the reversibly extendable recoil lug.

An example method for attaching a firearm accessory to a rail system comprises the following steps:

providing a firearm accessory comprising a body having a mounting interface configured for removable attachment to the rail system, the mounting interface including a pair of parallel engagement members configured to be slidably coupled to the rail system and an internal groove that defines shoulder surfaces; a reversibly extendable recoil lug disposed within a guide groove located in the mounting interface, between the parallel engagement members; and a threaded fastener comprising a head and a threaded shank; wherein the reversibly extendable recoil lug is configured to slidably fit within the guide groove and to be received within a cross slot of the rail system; the reversibly extendable recoil lug is advanced from and retracted into the guide groove by the threaded fastener; and the head of the threaded fastener is rotatably captured by the internal groove of the body and the threaded shank extends between the shoulder surfaces to threadedly engage with the reversibly extendable recoil lug;

slidably positioning the parallel engagement members of the firearm accessory on the rail system; and rotating the threaded fastener to advance the reversibly extendable recoil lug into a cross slot of the rail system.

BRIEF DESCRIPTION OF THE DRAWINGS

Like reference numerals refer to corresponding parts throughout the several views of the drawings.

DETAILED DESCRIPTION

Figure 1:
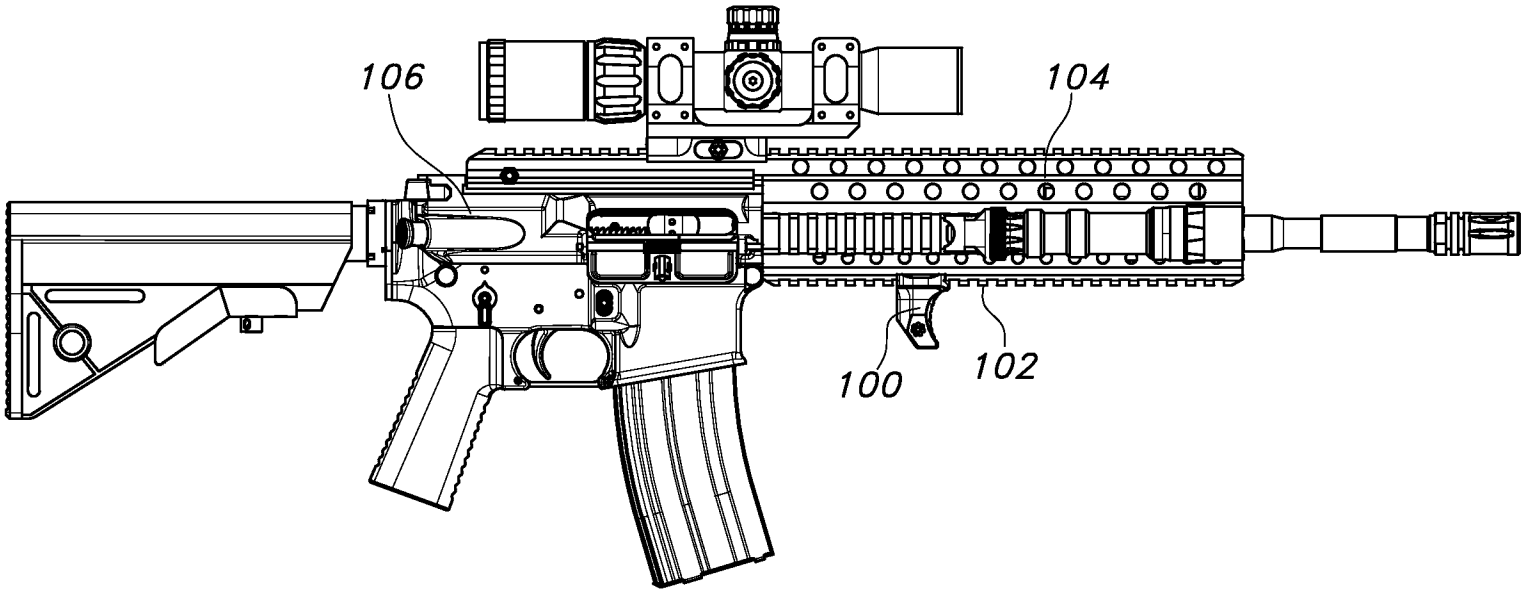
FIG. 1 is a right side elevational view of an example firearm accessory attached to a rail system of a firearm.

FIGS. 1-8 illustrate a firearm accessory 100 consistent with the principles of the present disclosure. More particularly, FIG. 1 illustrates the firearm accessory 100 attached to a rail system (a Picatinny rail 102) on the handguard 104 of a firearm (an AR-15 type rifle 106). The illustrated firearm accessory 100 is a hand stop. However, the firearm accessory 100 may be any accessory suitable for attachment to the rail system 102. For example, the firearm accessory 100 may be a vertical foregrip, a mount for an optical sight, a flashlight mount, a bipod, etc. The firearm accessory 100 may be attached at any location on the rail system 102.

Figure 2:
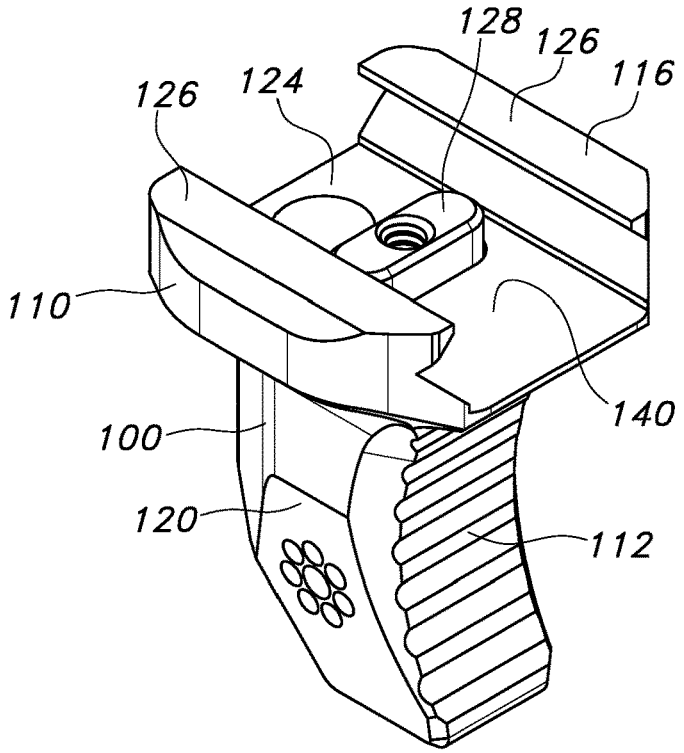
FIG. 2 is an isometric view of the firearm accessory shown in FIG. 1.
Figure 3:
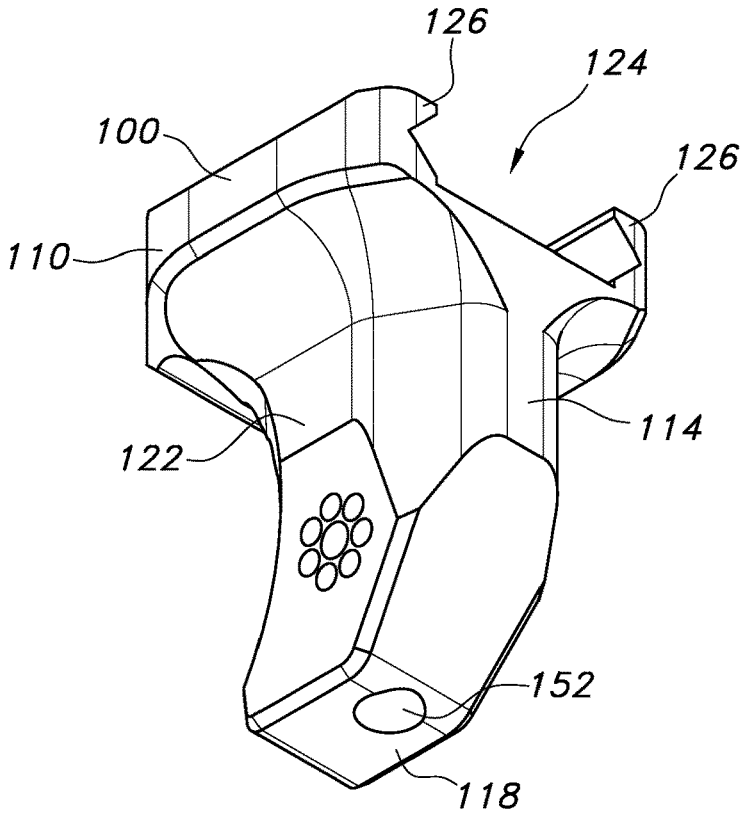
FIG. 3 is another isometric view of the firearm accessory shown in FIG. 1.
Figure 4:
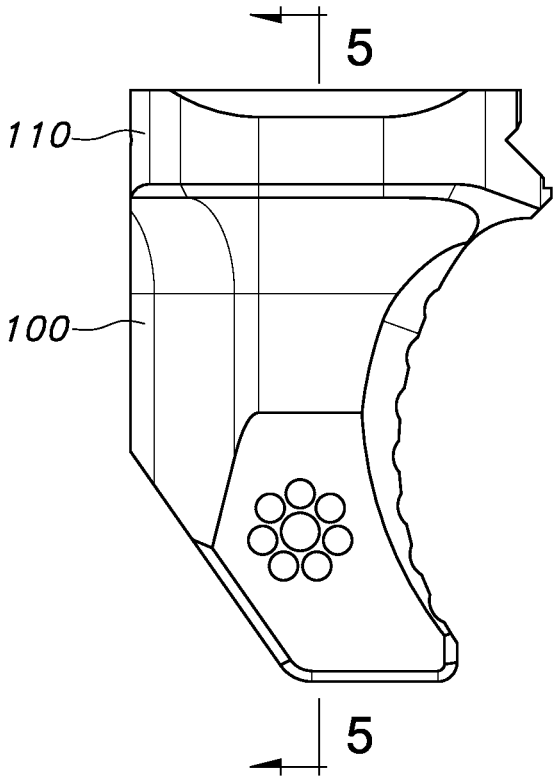
FIG. 4, is a right side elevational view of the firearm accessory shown in FIG. 1.

As shown in FIGS. 2 and 3, the firearm accessory 100 has a body 110 having a front 112, rear 114, top 116, bottom 118, right side 120, and left side 122. The top 116 of the body 110 includes a mounting interface 124 that enables the firearm accessory 100 to be removably connected to a Picatinny rail 102. The mounting interface 124 comprises a pair of parallel engagement members 126 configured to be slidably coupled to the rail system 102 and a reversibly extendable recoil lug 128.

The parallel engagement members 126 have downwardly and oppositely angulated surfaces (130 and 132) which are oriented for contact with correspondingly angulated support surfaces of the rail system 102. The parallel engagement members 126 also have upwardly and oppositely angulated surfaces (134 and 136) which are oriented for contact with correspondingly angulated clamping surfaces of the rail system 102.

Figure 5:
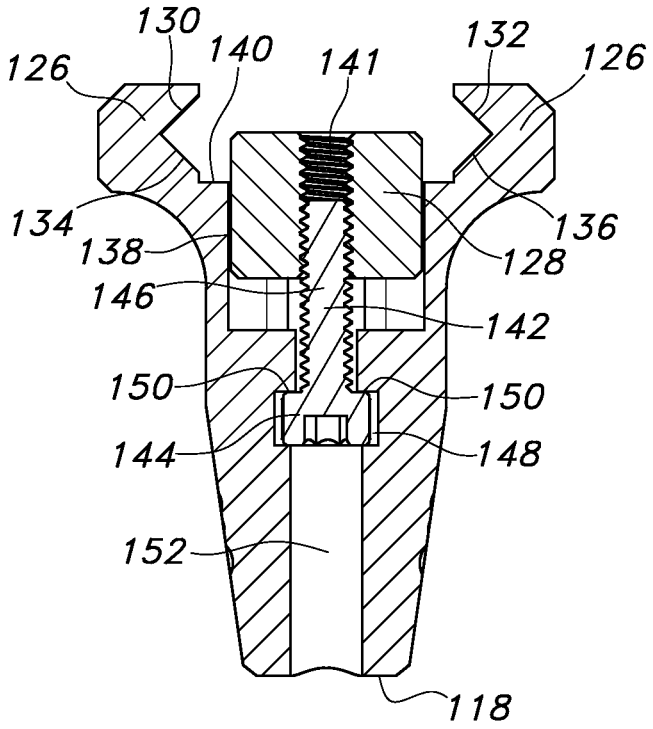
FIG. 5 is a cross-sectional view of the firearm accessory shown in FIG. 4, taken along line 5-5.
Figure 6:
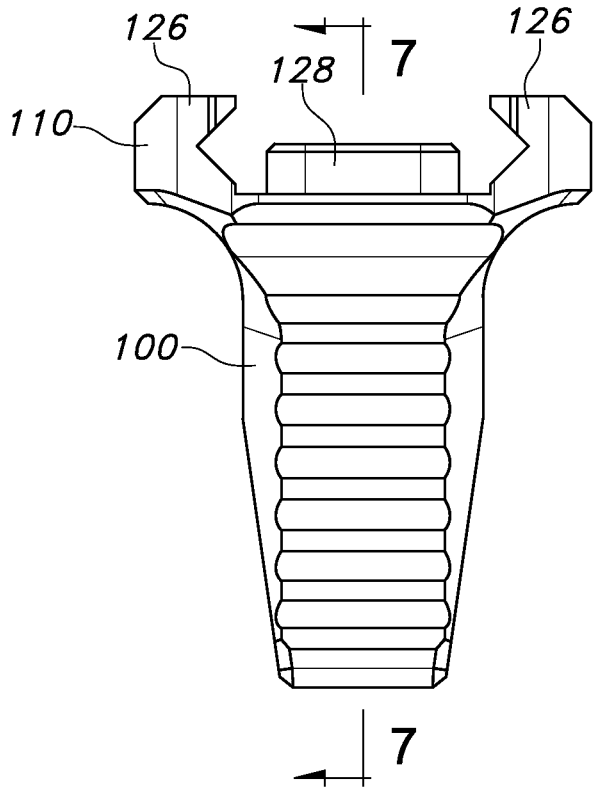
FIG. 6 is a front elevational view of the firearm accessory shown in FIG. 1.
Figure 7:
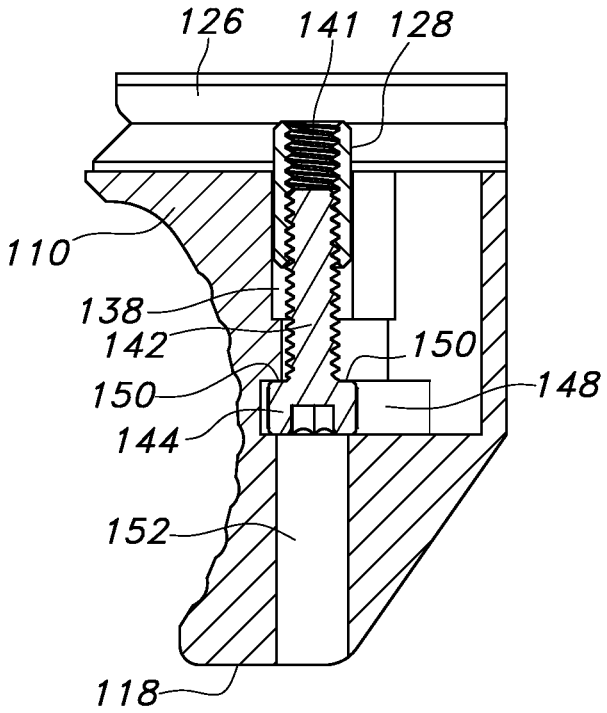
FIG. 7 is a cross-sectional view of the firearm accessory shown in FIG. 6, taken along line 7-7.
Figure 8:
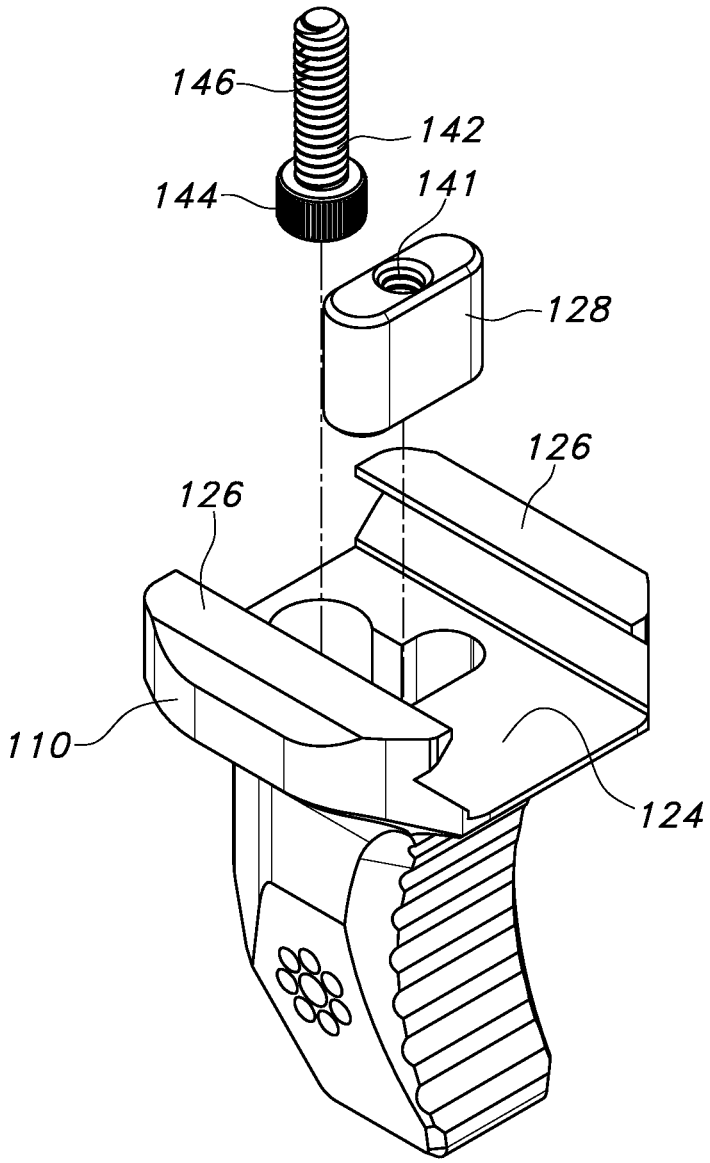
FIG. 8 is an exploded view of the firearm accessory shown in FIG. 1.

The recoil lug 128 is positioned within a guide groove 138 in an upwardly facing surface 140 of the mounting interface 124, between the parallel engagement members 126 (see, e.g., FIG. 5). The recoil lug 128 is configured to slidably fit within the guide groove 138 and to be received in any cross slot of the rail system 102. The recoil lug 128 includes a threaded opening 141 and, in some implementations, may have a discorectangle cross-sectional shape. The recoil lug 128 is advanced from/retracted into the guide groove 130 by an operatively connected threaded fastener 142. The threaded fastener 142 comprises a head 144 and a threaded shank 146, and is captured within the body 110 of the firearm accessory 100. In particular, the body 110 includes an internal groove 148 that defines shoulder surfaces 150 configured to enable the head 144 of the threaded fastener 142 to advance the recoil lug 128 from, and retract the recoil lug 128 into, the guide groove 138 (see, e.g., FIG. 5). The socket in the head 144 of the threaded fastener 142 is accessible through an aperture 152 in the bottom 118 of the body 110 (see, e.g., FIG. 5). The threaded fastener 142 can be rotated using a suitably configured Allen wrench, or other suitable configured L-shaped hexagonal metal bar. In some implementations, the bottom 118 of the body 110 may include direction indicia corresponding to positioning the recoil lug 128 in/removing the recoil lug 128 from a cross slot of the rail system 102.

Together, the parallel engagement members 126 and the reversibly extendable recoil lug 128 form a clamping mechanism used to removably attach the firearm accessory 100 to the rail system 102. The recoil lug 128 is captured within the guide groove 138 in the body 110 by the operatively connected threaded fastener 142. In this way, both the threaded fastener 142 and the recoil lug 128 are prevented from falling out of the body 110 when the firearm accessory 100 is removed from the rail system 102.

USE AND OPERATION

The following steps may be used to secure the firearm accessory 100 to the rail system 102 of a firearm. Initially, the parallel engagement members 126 are used to slidably position the firearm accessory 100 on the rail system 102. Then, once the firearm accessory 100 is positioned in a desirable location on the rail system 102, the user rotates the threaded fastener 142 is a counterclockwise direction, causing the recoil lug 128 to extend into a cross slot of the rail system 102. In this way, the firearm accessory 100 is attached to the rail system 102.

To remove/reposition the firearm accessory 100, the user rotates the threaded fastener 142 in a clockwise direction, causing the recoil lug 158 to withdraw from the cross slot of the rail system 102. Then, the user can remove the firearm accessory or reposition it on the rail system 102.

With respect to the above description, it is to be realized that the optimum dimensional relationships for the parts of the invention, to includes variations in size, materials, shape, form, function and manner of operation, assembly and use, are deemed readily apparent and obvious to one skilled in the art, and all equivalent relationships to those illustrated in the drawings and description in the specification are intended to be encompassed by the present invention.

The foregoing description of the invention is intended to be illustrative; it is not intended to be exhaustive or to limit the claims to the precise forms disclosed. Those skilled in the relevant art can appreciate that many modifications and variations are possible in light of the foregoing description and associated drawings.

Reference throughout this specification to an "embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A firearm accessory configured for attachment to a rail system, the firearm accessory comprising:

a body having a mounting interface configured for removable attachment to the rail system, the mounting interface including a pair of parallel engagement members configured to be slidably coupled to the rail system and an internal groove that defines shoulder surfaces;

a reversibly extendable recoil lug disposed within a guide groove located in the mounting interface, between the parallel engagement members; and a threaded fastener comprising a head and a threaded shank;

wherein:

the reversibly extendable recoil lug is configured to slidably fit within the guide groove and to be received within a cross slot of the rail system;

the reversibly extendable recoil lug is advanced from and retracted into the guide groove by the threaded fastener; and the head of the threaded fastener is rotatably captured by the internal groove of the body and the threaded shank extends between the shoulder surfaces to threadedly engage with the reversibly extendable recoil lug.

2. The firearm accessory of claim 1, wherein the pair of parallel engagement members includes downwardly and oppositely angulated surfaces oriented for contact with correspondingly angulated support surfaces of the rail system, and upwardly and oppositely angulated surfaces oriented for contact with correspondingly angulated clamping surfaces of the rail system.

3. The firearm accessory of claim 1, wherein the head of the threaded fastener is accessible through an aperture in the body configured to prevent the head of the threaded fastener from passing therethrough.

4. A method for attaching a firearm accessory to a rail system, the method comprising:

providing a firearm accessory comprising a body having a mounting interface configured for removable attachment to the rail system, the mounting interface including a pair of parallel engagement members configured to be slidably coupled to the rail system and an internal groove that defines shoulder surfaces; a reversibly extendable recoil lug disposed within a guide groove located in the mounting interface, between the parallel engagement members; and a threaded fastener comprising a head and a threaded shank; wherein the reversibly extendable recoil lug is configured to slidably fit within the guide groove and to be received within a cross slot of the rail system; the reversibly extendable recoil lug is advanced from and retracted into the guide groove by the threaded fastener; and the head of the threaded fastener is rotatably captured by the internal groove of the body and the threaded shank extends between the shoulder surfaces to threadedly engage with the reversibly extendable recoil lug;

slidably positioning the pair of parallel engagement members of the firearm accessory on the rail system; and rotating the threaded fastener to advance the reversibly extendable recoil lug into a cross slot of the rail system.

5. The method of claim 4, further comprising inserting a tool configured to rotate the threaded fastener through an aperture in the body of the firearm accessory.

6. The method of claim 4, wherein the head of the threaded fastener is accessible through an aperture in the body configured to prevent the head of the threaded fastener from passing therethrough.

* * * * *